US008360604B2

(12) United States Patent
Negley et al.

(10) Patent No.: US 8,360,604 B2
(45) Date of Patent: Jan. 29, 2013

(54) LIGHT EMITTING DIODE (LED) LIGHTING SYSTEMS INCLUDING LOW ABSORPTION, CONTROLLED REFLECTANCE ENCLOSURES

(75) Inventors: Gerald H. Negley, Chapel Hill, NC (US); Antony P. van de Ven, Sai Kung (HK)

(73) Assignee: Cree, Inc., Durham, NC (US)

( * ) Notice: Subject to any disclaimer, the term of this patent is extended or adjusted under 35 U.S.C. 154(b) by 709 days.

(21) Appl. No.: 12/570,571

(22) Filed: Sep. 30, 2009

(65) Prior Publication Data

US 2011/0075408 A1 Mar. 31, 2011

(51) Int. Cl.
*F21V 9/00* (2006.01)

(52) U.S. Cl. ..... 362/235; 362/249.02; 362/800; 362/231

(58) Field of Classification Search ..... 362/249.02, 362/231, 235, 800
See application file for complete search history.

(56) References Cited

U.S. PATENT DOCUMENTS

| | | | | |
|---|---|---|---|---|
| 6,898,012 | B2 | 5/2005 | Kaminsky et al. | |
| 7,055,987 | B2 * | 6/2006 | Staufert | 362/235 |
| 7,132,136 | B2 | 11/2006 | Laney et al. | |
| 7,160,012 | B2 * | 1/2007 | Hilscher et al. | 362/555 |
| 7,408,709 | B2 | 8/2008 | Shimoda et al. | |
| 2003/0165060 | A1 | 9/2003 | Ouderkirk et al. | |
| 2006/0237636 | A1 | 10/2006 | Lyons et al. | |
| 2007/0247414 | A1 | 10/2007 | Roberts | |
| 2007/0284592 | A1 | 12/2007 | Haase | |
| 2008/0225553 | A1 | 9/2008 | Roberts et al. | |
| 2010/0321919 | A1 * | 12/2010 | Yang | 362/84 |
| 2011/0075410 | A1 * | 3/2011 | Negley et al. | 362/231 |

OTHER PUBLICATIONS

International Preliminary Report on Patentability, PCT/US10/48843, May 16, 2012.

Flashlight News. Cree Announces Volume Availability of Cree LR24 Luminaire. Article [Online], 2008 [retrieved on Jan. 3, 2011], Retrieved from the internet; URL: http://flashlightnews.org/story1865.shtml ; 2 pages.

Furukawa America Inc. Furukawa America Debuts MCPET Reflective Sheets to improve Clarity and Efficiency of Lighting Fixtures, 2007. [retrieved on Jan. 3, 2011]. Retrieved from the internet URL: http://www.thefreelibrary.com/Furukawa+America+Debuts+MCPET+Reflective+Sheets+to+Improve+Clarity...-a0163370179 ; pp. 1-3.

Notification of Transmittal of the International Search Report and the Written Opinion of the International Searching Authority, or the Declaration; International Search Report; Written Opinion of the International Searching Authority Corresponding to International Application No. PCT/US2010/048843 dated Jan. 20, 2011; 13 pages.

"*Bright Tomorrow Lighting Competition* (*L Prize*™)", May 28, 2008, Document No. 08NT006643.

"*ENERGY STAR® Program Requirements for Solid State Lighting Luminaires, Eligibility Criteria—Version 1.1*", Final: Dec. 19, 2008.

(Continued)

*Primary Examiner* — Anabel Ton
(74) *Attorney, Agent, or Firm* — Myers Bigel Sibley & Sajovec, P.A.

(57) ABSTRACT

LED lighting systems include an enclosure adjacent at least one LED that is configured so that at least some light that is emitted by the at least one LED passes through the enclosure. The enclosure has less than about 10% total absorption. The enclosure also has a transmittance-to-reflectance ratio that is configured to homogenize light that emerges from the enclosure (1) directly from the at least one LED, and (2) after one or more reflections within the enclosure.

38 Claims, 3 Drawing Sheets

OTHER PUBLICATIONS

DuPont "*DuPont™ Diffuse Light Reflector*", Publication K-20044, May 2008, 2 pp.

Furukawa Electric Co., Ltd., Data Sheet, "*New Material for Illuminated Panels Microcellular Reflective Sheet MCPET*", updated Apr. 8, 2008, 2 pp.

LEDs MAgazines, Press Release May 23, 2007, "*Furukawa America Debuts MCPET Reflective Sheets to Improve Clarity, Efficiency of Lighting Fixtures*", downloaded Jun. 25, 2009 from http://www.ledsmagazine.com/press/15145, 2 pp.

"*MCPET*", downloaded Jun. 25, 2009 from http:trocellen.com/index.php?option=com_content&view=article&id=96&Itemid=....

* cited by examiner

LIGHT EMITTING DIODE (LED) LIGHTING SYSTEMS INCLUDING LOW ABSORPTION, CONTROLLED REFLECTANCE ENCLOSURES

BACKGROUND OF THE INVENTION

This invention relates to lighting systems and, more particularly, to lighting systems that use light emitting diodes (LEDs).

LEDs are increasingly being used in lighting/illumination applications, such as traffic signals, color wall wash lighting, backlights, displays and general illumination, with one ultimate goal being a replacement for the ubiquitous incandescent light bulb. In order to provide a broad spectrum light source, such as a white light source, from a relatively narrow spectrum light source, such as an LED, the relatively narrow spectrum of the LED may be shifted and/or spread in wavelength.

For example, a white LED may be formed by coating a blue emitting LED with an encapsulant material, such as a resin or silicon, that includes therein a wavelength conversion material, such as a YAG:Ce phosphor, that emits yellow light in response to stimulation with blue light. Some, but not all, of the blue light that is emitted by the LED is absorbed by the phosphor, causing the phosphor to emit yellow light. The blue light emitted by the LED that is not absorbed by the phosphor combines with the yellow light emitted by the phosphor, to produce light that is perceived as white by an observer. Other combinations also may be used. For example, a red emitting phosphor can be mixed with the yellow phosphor to produce light having better color temperature and/or better color rendering properties. Alternatively, one or more red LEDs may be used to supplement the light emitted by the yellow phosphor-coated blue LED. In other alternatives, separate red, green and blue LEDs may be used. Moreover, infrared (IR) or ultraviolet (UV) LEDs may be used. Finally, any or all of these combinations may be used to produce colors other than white.

LEDs also may be energy efficient, so as to satisfy ENERGY STAR® program requirements. ENERGY STAR program requirements for LEDs are defined in "*ENERGY STAR® Program Requirements for Solid State Lighting Luminaires, Eligibility Criteria—Version* 1.1", Final: Dec. 19, 2008, the disclosure of which is hereby incorporated herein by reference in its entirety as if set forth fully herein.

In order to encourage development and deployment of highly energy efficient solid state lighting (SSL) products to replace several of the most common lighting products currently used in the United States, including 60-watt A19 incandescent and PAR 38 halogen incandescent lamps, the Bright Tomorrow Lighting Competition (L Prize™) has been authorized in the Energy Independence and Security Act of 2007 (EISA). The L Prize is described in "*Bright Tomorrow Lighting Competition* (*L Prizen*™)", May 28, 2008, Document No. 08NT006643, the disclosure of which is hereby incorporated herein by reference in its entirety as if set forth fully herein. The L Prize winner must conform to many product requirements including light output, wattage, color rendering index, correlated color temperature, dimensions and base type.

SUMMARY OF THE INVENTION

LED lighting systems according to various embodiments described herein include at least one LED and an enclosure adjacent the at least one LED, that is configured so that at least some light that is emitted by the at least one LED passes through the enclosure. The enclosure has a transmittance-to-reflectance ratio that is configured to homogenize light that emerges from the enclosure (1) directly from the at least one LED, and (2) after one or more reflections within the enclosure. Accordingly, the enclosure is configured to control the relative amount of light that is transmitted and reflected, so that the light is evenly diffused and the colors inside the disclosures are mixed to provide homogeneous light that emerges from the enclosure.

In some embodiments, the enclosure has less than about 10%, and in other embodiments less than about 4%, total absorption of the light that is emitted by the at least one LED. In some embodiments, the enclosure comprises a microcellular layer having a mean cell diameter of less than about 10 μm. In other embodiments, the enclosure comprises a microporous layer. In some embodiments, the enclosure comprises low absorption diffusing material such as a layer of microcellular polyethylene terephthalate (MCPET) and/or a layer of Diffuse Light Reflector (DLR) material.

In other embodiments, the enclosure has a transmittance-to-reflectance ratio that varies at different locations thereof. In some embodiments, the microcellular layer of MCPET and/or DLR material is of variable thickness at different locations thereof to provide the transmittance-to-reflectance ratio that varies at different locations thereof. In other embodiments, the microcellular layer of MCPET and/or DLR material includes a non-uniform array of holes extending therethrough to provide the transmittance-to-reflectance ratio that varies at different locations thereof. Yet other embodiments can provide a layer of variable thickness and/or a patterned layer on the layer of MCPET and/or DLR material. In yet other embodiments, the enclosure comprises a reflective layer having an array of holes thereof.

In still other embodiments, the enclosure comprises a bulb-shaped enclosure and a screw-type base at the base of the bulb-shaped enclosure. The bulb-shaped enclosure may have higher transmittance-to-reflectance ratio remote from the screw-type base than adjacent the screw-type base. In still other embodiments, the LED lighting system may conform to the ENERGY STAR Program Requirements for Solid State Lighting Luminaires. In yet other embodiments, the LED lighting system may further conform to the product requirements for light output, wattage, color rendering index, correlated color temperature, dimensions and base type of a 60-watt A19 or a PAR 38 Incandescent Replacement for the L Prize.

Many different embodiments of LEDs may be provided in LED lighting systems described herein. For example, in some embodiments, the at least one LED comprises first and second LEDs of different colors. In other embodiments, the at least one LED comprises first and second spaced apart LEDs of same color. Combinations of these and/or other embodiments also may be provided.

LED lighting systems according to still other embodiments, provide at least one LED and a layer adjacent the at least one LED that is configured so that at least some light that is emitted by the at least one LED passes through the layer. The layer has less than about 10% total absorption of the light that is emitted by the at least one LED and has a transmittance-to-reflectance ratio that that varies at different locations thereof. In other embodiments, the layer may have less than about 4% total absorption, may comprise low absorption microcellular/microporous diffusing material such as MCPET and/or DLR material, may be of variable thickness and/or may include a non-uniform array of holes extending therethrough, as was described above. The layer may also comprise a bulb-shaped layer, and the LED lighting system may conform to the ENERGY STAR Program Requirements for Solid State Lighting Luminaires or a 60-watt A19 or a PAR 38 Incandescent Replacement for the L Prize, as was described above. The LEDs also may comprise various combinations of LEDs, as was described above.

Finally, still other embodiments provide an LED lighting system that includes at least one LED and a layer adjacent the at least one LED that is configured so that at least some light that is emitted by the at least one LED passes through the layer. The layer comprises light diffusing material having less than 4% total absorption of the light that is emitted by the at least one LED. In some embodiments, the enclosure comprises a layer of microcellular polyethylene terephthalate (MCPET) and/or a layer of Diffuse Light Reflector (DLR) material. The layer may be of variable thickness and/or may include a non-uniform array of holes extending therethrough, as was described above. The layer may also comprise a bulb-shaped layer, and the LED lighting system may conform to the ENERGY STAR Program Requirements for Solid State Lighting Luminaires or a 60-watt A19 or a PAR 38 Incandescent Replacement for the L Prize, as was described above. The LEDs also may comprise various combinations of LEDs, as was described above.

DETAILED DESCRIPTION

Figure 1:
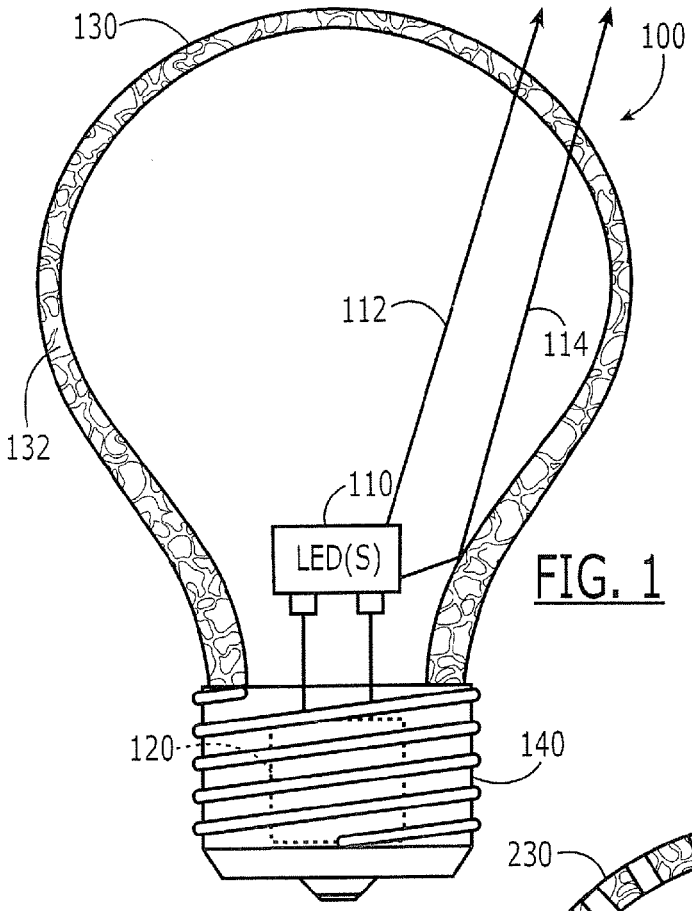
FIGS. 1-5 are side cross-sectional views of LED lighting systems according to various embodiments.

The present invention now will be described more fully with reference to the accompanying drawings, in which various embodiments are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. In contrast, the term "consisting of" when used in this specification, specifies the stated features, steps, operations, elements, and/or components, and precludes additional features, steps, operations, elements and/or components. Finally, "a layer of MCPET" means "a layer comprising MCPET", and "a layer of DLR material" means "a layer comprising DLR material".

It will be understood that when an element such as a layer, region or substrate is referred to as being "on" another element, it can be directly on the other element or intervening elements may also be present. Furthermore, relative terms such as "beneath" or "overlies" may be used herein to describe a relationship of one layer or region to another layer or region relative to a substrate or base as illustrated in the figures. It will be understood that these terms are intended to encompass different orientations of the device in addition to the orientation depicted in the figures. Finally, the term "directly" means that there are no intervening elements. As used herein, the term "and/or" includes any and all combinations of one or more of the associated listed items and may be abbreviated as "/".

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Embodiments of the invention are described herein with reference to cross-sectional and/or other illustrations that are schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, a region illustrated or described as a rectangle will, typically, have rounded or curved features due to normal manufacturing tolerances. Thus, the regions illustrated in the figures are schematic in nature and their shapes are not intended to illustrate the precise shape of a region of a device and are not intended to limit the scope of the invention, unless otherwise defined herein. Moreover, all numerical quantities described herein are approximate and should not be deemed to be exact unless so stated.

Unless otherwise defined herein, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

As used herein, a layer or region is considered to be "transparent" when at least 50% of the radiation that impinges on the transparent layer or region emerges through the transparent layer or region. Moreover, the term "phosphor" is used synonymously for any wavelength conversion material(s). The term "ENERGY STAR" is defined by "*ENERGY STAR Program Requirements for Solid State Lighting Luminaires, Version* 1.0", cited above. The term "L Prize" is defined by the "*Bright Tomorrow Lighting Competition* (*L Prize*™)" Publication No. 08NT006643, cited above.

Some embodiments described herein can use gallium nitride (GaN)-based LEDs on silicon carbide (SiC)-based mounting substrates. However, it will be understood by those having skill in the art that other embodiments of the present invention may be based on a variety of different combinations of mounting substrate and epitaxial layers. For example, combinations can include AlGaInP LEDs on GaP mounting substrates; InGaAs LEDs on GaAs mounting substrates; AlGaAs LEDs on GaAs mounting substrates; SiC LEDs on SiC or sapphire ($Al_2O_3$) mounting substrates and/or Group III-nitride-based LEDs on gallium nitride, silicon carbide, aluminum nitride, sapphire, zinc oxide and/or other mounting substrates. Moreover, in other embodiments, a mounting substrate may not be present in the finished product. In some embodiments, the LEDs may be gallium nitride-based LED devices manufactured and sold by Cree, Inc. of Durham, N.C., and described generally at cree.com.

FIG. 1 is a schematic cross-sectional view of an LED lighting system according to various embodiments. Referring to FIG. 1, the LED lighting system 100 includes at least one LED 110 and a power supply 120 that is electrically connected to, and in some embodiments spaced apart from, the at least one LED 110. The power supply 120 may provide a ballast for the LED lighting system 100 by converting an input alternating current (AC) to a direct current (DC). However, in other embodiments, the power supply 120 may only include a resistor or any other device that sets a bias current for the at least one LED 110. In yet other embodiments, a power supply 120 need not be provided.

The at least one LED 110 may include a bare LED die, an encapsulated or packaged LED and/or an LED (bare or encapsulated) with phosphor thereon. Moreover, multiple LEDs may also be provided in various combinations and subcombinations. In some embodiments, a red LED is provided in addition to a blue LED. The use of a red LED to supplement a blue LED is described, for example, in U.S. Pat. No. 7,213,940 to the present inventors, the disclosure of which is hereby incorporated herein by reference in its entirety as if set forth fully herein.

Still referring to FIG. 1, an enclosure 130 is also provided adjacent the at least one LED 110, and in some embodiments that surrounds the at least one LED 110, so that at least some light that is emitted by the at least one LED 110 passes through the enclosure 130. The enclosure has low total absorption of the light that is emitted by the at least one LED 110. In some embodiments, the enclosure 130 has less than about 10% total absorption and in other embodiments, less than about 4% total absorption is provided. In still other embodiments, less than about 2% absorption is provided. In FIG. 1, the enclosure 130 is configured to provide a replacement for conventional "A-type" form factor light bulbs. In these embodiments, the enclosure 130 is a bulb-shaped enclosure, and a screw-type base 140 is provided at the base of the enclosure 130. In embodiments of FIG. 1, the at least one LED 110 is included within the bulb-shaped enclosure 130, and the power supply 120 is included within the base 140. However, in other embodiments, the power supply 120 may also be included at least partially outside the base 140, or may be omitted.

According to various embodiments described herein, the enclosure 130 also has a transmittance-to-reflectance ratio that is configured to homogenize light that emerges from the enclosure 130 directly from the at least one LED, as shown by the light ray 112, and after one or more reflections within the enclosure, as shown by light ray 114. Thus, the transmittance-to-reflectance ratio of the low absorption enclosure is controlled so that light is evenly diffused and mixed within the enclosure, to provide a homogeneous light output from the enclosure.

Some embodiments described herein may arise from recognition that a new class of low absorption diffusing light reflector materials has recently been developed. These materials include microcellular polyethylene terephthalate (MCPET) and Diffused Light Reflector (DLR) materials. These low absorption microcellular materials are white diffusing materials that can provide reflectance that is at least 96%, and may be as high as 98%, across the visible spectrum. These microcellular materials have a mean cell diameter of less than about 10 μm to create a microporous material. These materials have been used as reflectors in fluorescent light fixtures, and can increase fixture light output as much as 20% or more. According to various embodiments described herein, a different use has been made for these materials, i.e., as an enclosure layer that is configured so that almost all of the light passes through the enclosure with low total absorption. However, the configuration of the layer may be tailored to provide a desired transmittance-to-reflectance ratio, so as to homogenize the light that emerges from the enclosure, whether the light emerges directly from the LED or after one or more reflections or bounces within the enclosure.

Even more specifically, it is known that light that impinges on a material is impacted by the absorption, transmission and reflection of the material. Various materials described herein may have less than about 10% total absorption in some embodiments. In other embodiments, less than about 4% total absorption may be provided, and in other embodiments, less than about 2% total absorption may be provided. The remaining light that is not absorbed is either transmitted through the material or reflected from the material. For example, a range of transmission of between about 10% and about 80% may be provided, and conversely a range of reflection from about 80% to about 10% may be provided, wherein the absorption, transmission and reflection add to 100%. The low absorption material may be modified geometrically and/or by the addition of a coating layer thereon, to provide a desired transmittance-to-reflectance ratio that is configured to homogenize light that emerges from the enclosure directly from the at least one LED and after one or more reflections within the enclosure.

As is known to those having skill in the art, MCPET reflective sheets may comprise micro-foamed polyethylene terephthalate having a mean cell diameter of about 10 μm or less, i.e., less than about 10 μm. The MCPET sheets may exhibit a total reflectivity of 99% or more and a diffuse reflectivity of 96% or more. Thus, the microcellular structure randomizes and scatters the light impinging thereon. Moreover, MCPET sheets can reflect blue light with wavelengths of 400 nm and red light with wavelengths of 700 nm nearly equally. A 1-mm thick MCPET sheet may achieve a total light reflectivity of 99% and a diffuse reflectivity of 96% compared to conventional mirrored or metallic reflection panels that achieve only 10% diffuse reflectance ratio and restrict the total light reflected to a single direction. MCPET is further described in the data sheet entitled "*New Material for Illuminated Panels Microcellular Reflective Sheet MCPET*", by the Furukawa Electric Co., Ltd., updated Apr. 8, 2008, and in a publication entitled "*Furukawa America Debuts MCPET Reflective Sheets to Improve Clarity, Efficiency of Lighting Fixtures*", *LED Magazine,* 23 May 2007, the disclosures of both of which are hereby incorporated herein by reference in their entirety as if set forth fully herein.

As is also known to those having skill in the art, DLR reflective sheets are marketed by DuPont. The DuPont™ DLR is a white material providing reflectance as high as 98% across the visible spectrum. Used as a reflector in fluorescent light fixtures, it can increase fixture light output as much as 20%. DLR material is further described in a data sheet entitled "*DuPont™ Diffuse Light Reflector*", DuPont publication K-20044, May 2008, and is also described at diffuse-lightreflector.dupont.com, the disclosures of both of which are hereby incorporated herein by reference in their entirety as if set forth fully herein.

It will also be understood that although MCPET and DLR have been described extensively herein, other microcellular light diffusing material having less than about 4%, and in some embodiments less than about 2%, total absorption of the light that is emitted by the at least one LED 110 may also be used in various other embodiments. These materials may be referred to generally as "low absorption diffusing materials".

Some embodiments described herein may arise from recognition that a microcellular layer may be made sufficiently thin or otherwise tailored so that the microcellular structures define micropores therebetween, which can allow a desired amount of the light to be transmitted through the material. Thus, rather than total reflection, some of the light may be transmitted through the microcellular light diffusing material. The transmittance-to-reflectance ratio may be tailored by adjusting the thickness and/or particle size of the microcellular light diffusing material and/or by adding one or more coating layers thereto.

According to various embodiments described herein, at least a portion of the enclosure 130 comprises a layer of low absorption diffusing material such as a layer of MCPET and/or DLR material 132. In some embodiments, the enclosure 130 has a transmittance-to-reflectance ratio that varies across the enclosure 130. In other embodiments, the layer of MCPET/DLR itself has a variable transmittance-to-reflectance ratio. For example, as shown in FIG. 1, the layer of MCPET/DLR 132 is of variable thickness to provide a transmittance-to-reflectance ratio that varies across the enclosure 130. As also in shown in FIG. 1, in some embodiments, the layer of MCPET/DLR 132 is thicker adjacent the base 140 than remote from the base 140 to provide a higher transmittance-to-reflectance ratio remote from the base 140 than adjacent the base 140. In some embodiments, the entire enclosure 130 may consist of the layer of MCPET/DLR 132. In other embodiments, the layer of MCPET/DLR 132 may itself be on another layer that provides structural support and/or other mechanical, optical and/or thermal properties.

The thickness and/or change in thickness of the layer of MCPET/DLR 132 may vary considerably based on the configuration of the LEDs 110 and the enclosure 130. The change in thickness may be abrupt or may be gradual, and need not be monotonic or symmetrical. Accordingly, embodiments of FIG. 1 also illustrate embodiments wherein at least a portion of the enclosure has a transmittance-to-reflectance ratio that varies across the enclosure.

Figure 2:
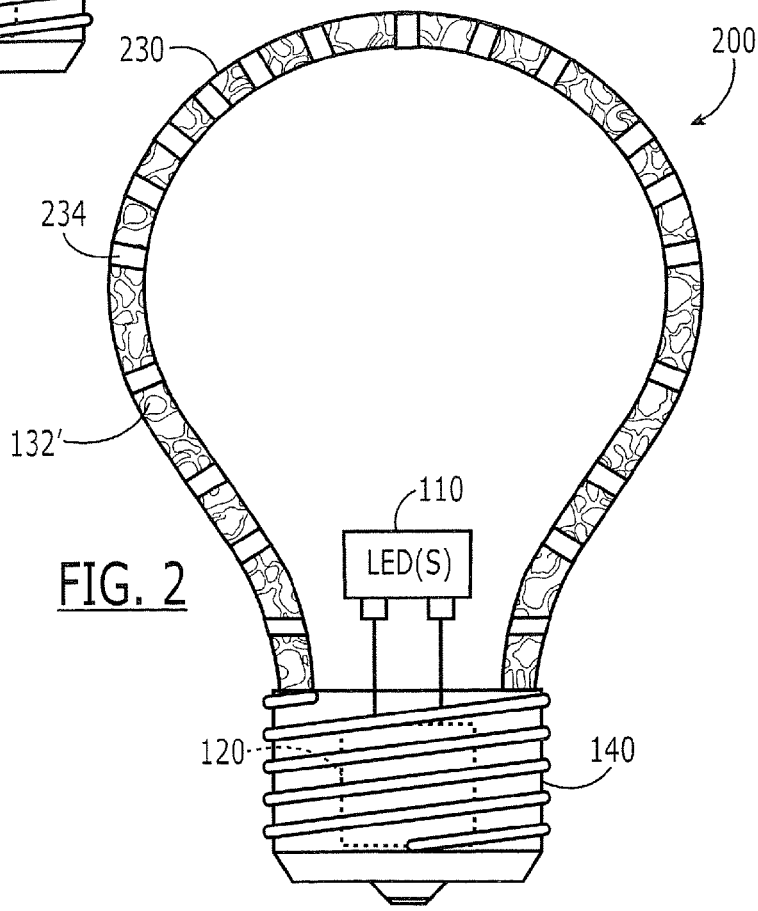

FIG. 2 illustrates other embodiments of LED lighting systems 200. In these embodiments, the enclosure 230 is provided with a variable transmittance-to-reflectance ratio by providing a non-uniform array of holes 234 that extend through a layer of low absorption diffusing material such as MCPET/DLR 132' that is of uniform thickness. The non-uniform array of holes 234 may be more closely spaced remote from the base 140 than adjacent the base 140, as illustrated in FIG. 2. However, many other configurations may be provided according to other embodiments. The non-uniform array of holes 234 may also be provided by changing the packing density, shape and/or size of the holes 234. It will also be understood that combinations of non-uniform thickness enclosures of FIG. 1 and non-uniform arrays of holes 234 of FIG. 2 may also be provided.

In FIGS. 1 and 2, the enclosure 130/230 consists of a layer of MCPET/DLR 132/132', so that in these embodiments the variation in the transmittance-to-reflectance ratio may be provided by the layer of MCPET/DLR itself. Other embodiments, illustrated for example in FIGS. 3-4, include a multilayer enclosure that includes a layer of MCPET/DLR, wherein the enclosure has a variable transmittance-to-reflectance ratio thereacross.

Figure 3:
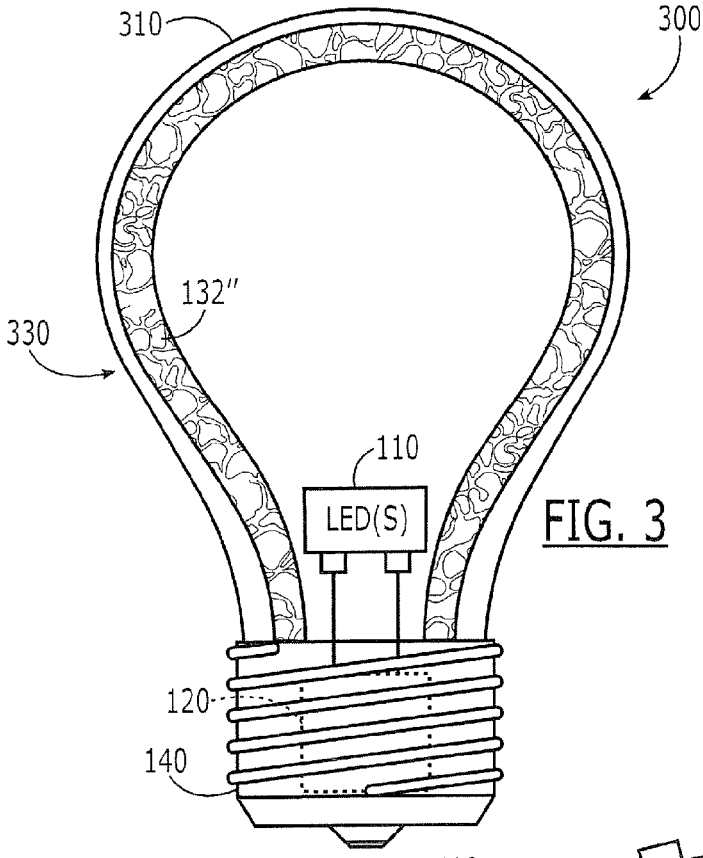

For example, as shown in FIG. 3, an LED lighting system 300 includes an enclosure 330 comprising a layer of low absorption diffusing material such as MCPET/DLR 132" of constant thickness and a layer 310 of variable thickness on the layer of MCPET/DLR 132" of constant thickness. The layer 310 of variable thickness may comprise a conventional diffusive material. As shown in FIG. 3, the layer 310 of variable thickness may be thicker adjacent the base 140 than remote from the base 140. Moreover, although the layer of variable thickness 310 is shown outside the layer of MCPET/DLR 132", it may alternatively or additionally be provided inside the layer of MCPET/DLR 132". Embodiments of FIGS. 1, 2 and 3 may also be combined by providing a layer of variable thickness 310 in addition to a layer of MCPET/DLR of variable thickness 132 and/or including holes 234. In still other embodiments, the layer 310 may have constant thickness and the layer of MCPET/DLR 132" may have a variable thickness.

Figure 4:
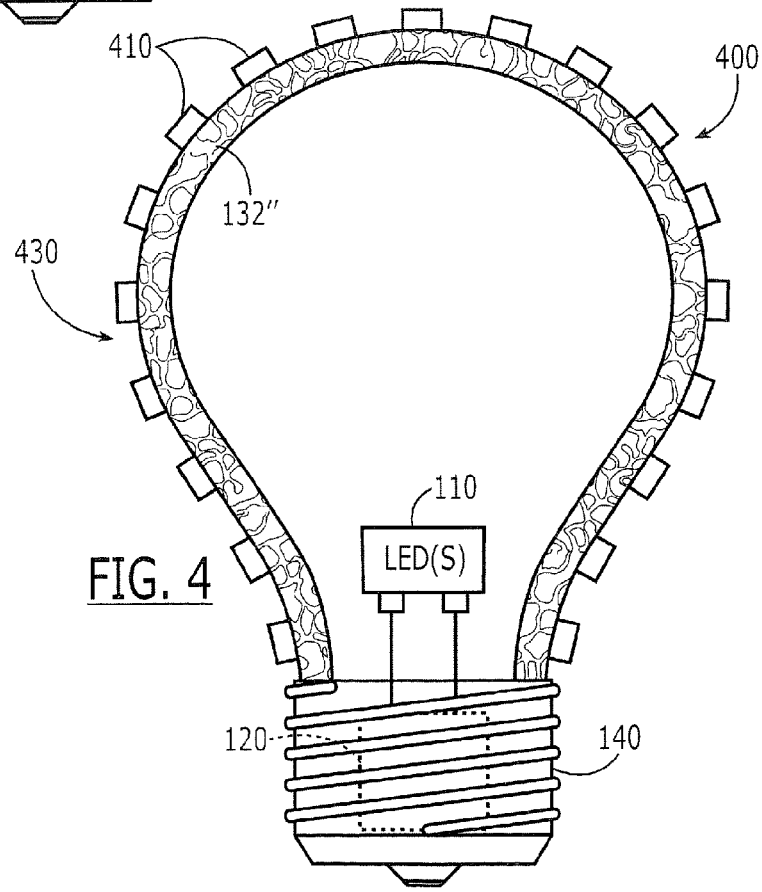

FIG. 4 is a cross-sectional view of LED lighting systems according to still other embodiments. These LED lighting systems 400 include a layer of low absorption diffusing material such as MCPET/DLR of constant thickness 132" and a patterned layer 410 on the layer of MCPET/DLR of constant thickness 132". The patterned layer 410 may include an array of intersecting lines, an array of islands, such as dots or other features, and/or any other patterned layer. The patterned layer 310 may be reflective. The patterned layer 410 may be uniform across the enclosure 430, or may vary in thickness, density and/or type of pattern across the enclosure 430. Moreover, a patterned layer 310 may be provided inside and/or outside the enclosure 430. Thus, in some embodiments, an enclosure may include a highly reflective inside surface and is perforated with a large number of small holes to let some of the light out. Light not exiting the holes is reflected back in, so that it can exit a different hole in a different direction. Finally, embodiments of FIG. 4 may be combined with embodiments of FIGS. 1, 2 and/or 3 in various other combinations, so that, for example, a layer of MCPET/DLR of variable thickness 132 of FIG. 1 is provided.

Accordingly, an LED lighting system 400 according to various embodiments can include at least one LED 110 and an enclosure 430 adjacent, and in some embodiments surrounding, the at least one LED 110, so that at least some light (and in some embodiments at least about 90%, 96% or 98% of the light) that is emitted by the at least one LED 110 passes through the enclosure 430. The enclosure 430 comprises a transmissive material 132" having a patterned reflective layer 410 thereon. The patterned reflective layer 410 may comprise an array of lines and/or islands.

Figure 5:
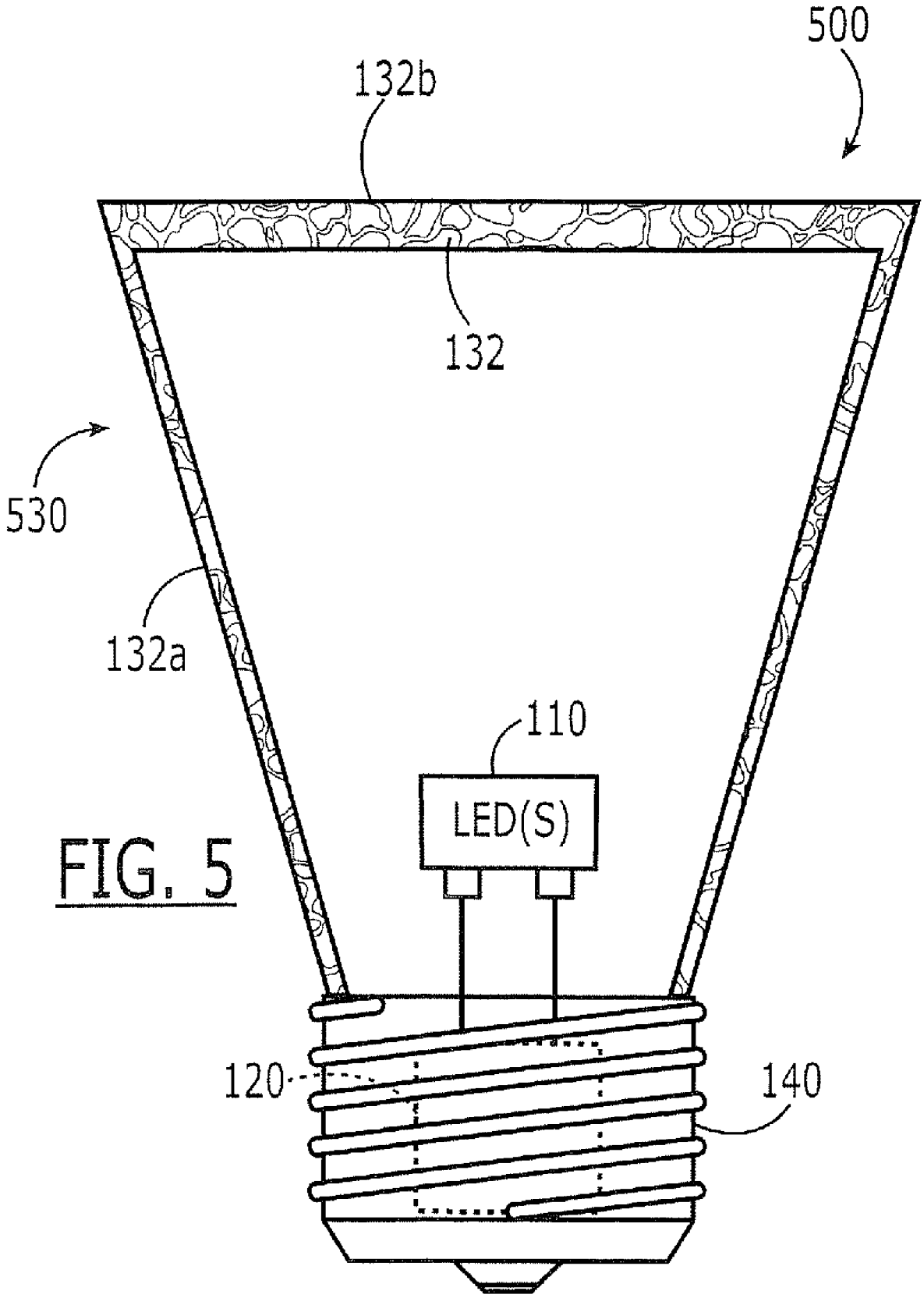

FIGS. 1-4 illustrate LED lighting systems in the form of a replacement for an A-type incandescent lamp. However, other embodiments may provide a replacement for a PAR 38 incandescent lamp or other form factors. In particular, FIG. 5 illustrates an embodiment that is similar to FIG. 1, but is in the configuration of a PAR 38 incandescent lamp. Thus, LED lighting systems 500 of FIG. 5 include an enclosure 530 having a layer of low absorption diffusing material such as MCPET/DLR of non-uniform thickness 132, where the wall **132*a* is thicker than the ceiling 132*b*, to provide a lower transmittance-to-reflectance ratio on the wall 132*a* than on the ceiling 132*b*. The wall 132*a* and/or the ceiling 132*b* itself may also be non-uniform in thickness in other embodiments. Other analogous embodiments to FIGS. 2, 3 and/or 4** may also be provided for a PAR 38 bulb.

Accordingly, various embodiments described herein can use reflective and transmissive properties of a film or other surrounding material to provide mixed light output from the light sources contained within an enclosure defined by the material. Various embodiments can balance the reflectivity from the material that reflects light back into the enclosure with the transmission through the material (i.e., the transmittance-to-reflectance ratio), so that the light that is transmitted is a substantially uniform color across the surface area of the material and absorption is reduced or minimized. Substantially uniform color may be defined as meeting the color uniformity requirements of the L Prize.

Highly reflective and diffusive microcellular materials, such as MCPET and/or DLR, have very little loss in reflection (e.g., about 2% or less), but may also have microporous characteristics, so as to transmit light through them. The level of transmission from an enclosure may be controlled by, for example, varying the thickness of MCPET/DLR (e.g., FIGS. 1, 3 and 5), by providing a non-uniform array of holes (e.g., FIG. 2), by varying the thickness of a transmissive/reflective layer on the MCPET (e.g., FIG. 3) and/or providing strips or dots of reflective material on an otherwise transmissive material (e.g., FIG. 4). The holes may comprise micropores that are created by the scattering from the microcells. Adjusting the balance between the amount of light transmitted and the amount of light reflected may control the number of bounces of light within the enclosure before the light is transmitted through the enclosure material. The number of bounces should be sufficient to mix the light from different color sources, single sources that emit multiple colors (for example, phosphor-converted LEDs that have a blue spot or yellow ring) and/or obscure multiple sources of the same color. This may be achieved by areas of high reflectivity and other regions of high transmissivity, and the ratio of number of regions and/or the comparative sizes of the regions may be adjusted to provide adequate color mixing. The sizes of the regions can range from, for example, square micrometers to square centimeters. Accordingly, various embodiments described herein may be counterintuitive in that at least some light that is emitted by the LED(s) is not allowed to initially escape through the enclosure, but is reflected back into the enclosure at least once.

Heretofore, MCPET/DLR have been used as a reflective sheet in backlight systems or sign boards, due at least in part to their high reflectivity, high diffusivity and relatively equivalent reflectivity/diffusivity across the visible spectrum. However, various embodiments described herein can use the MCPET/DLR for its transmissive properties, as well. Heretofore, the transmittance-to-reflectance ratio was minimized so that very little transmittance and very high reflectance was provided. In sharp contrast, various embodiments described herein can provide a lower transmittance-to-reflectance ratio, so that some light can exit the enclosure without bounce, and the remaining light that is reflected can also exit the enclosure after one or more bounces. Moreover, by varying the transmittance-to-reflectance ratio over various portions of the enclosure, a substantially uniform color and/or intensity may be provided across the surface area of the enclosure, notwithstanding the non-uniform illumination pattern of the LED(s) and/or the use of multiple LEDs of the same and/or different colors. Accordingly, low absorption diffusing materials such as MCPET/DLR may be used in a manner that is different from their intended use, for example by making the MCPET/DLR thinner than is conventional, non-uniform and/or including holes and/or micropores, to increase their transmissivity.

It will be understood that a differing transmittance-to-reflectance ratio has been described herein as being provided by varying the thickness of the layer of MCPET/DLR and/or by varying the thickness and/or patterning of a layer on the layer of MCPET/DLR. The varying thickness of MCPET/DLR may be provided by initially molding a layer of MCPET/DLR of varying thickness and/or by abrading, scraping and/or otherwise selectively removing at least some of the MCPET/DLR from a layer of MCPET/DLR. This selective removal may take place prior to forming the enclosure and/or after forming the enclosure. Moreover, other embodiments may vary the transmittance-to-reflectance ratio by varying the density and/or average cell size of the MCPET/DLR cells themselves to create micropores. Moreover, the transmittance-to-reflectance ratio may be varied in other embodiments by providing a non-uniform array of holes and/or micropores that extend through the MCPET/DLR. The non-uniform array of holes may be provided by initialing molding a layer of MCPET/DLR with holes and/or by otherwise selectively removing the MCPET/DLR after fabrication to provide the holes.

Various embodiments as described herein can conform to the ENERGY STAR Program Requirements for Solid State Lighting Luminaires. Moreover, various embodiments described herein (for example, FIGS. 1-4) can conform to the product requirements for light output, wattage, color rendering index, correlated color temperature, dimensions and base type for a 60-watt A19 Incandescent Replacement for the L Prize. Other embodiments (for example, FIG. 5) can conform to the product requirements for light output, wattage, color rendering index, correlated color temperature, dimensions and base type for a PAR 38 halogen replacement for the L Prize.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A light emitting diode (LED) lighting system comprising:

at least one LED; and an enclosure adjacent the at least one LED and configured so that at least some light that is emitted by the at least one LED passes through the enclosure, the enclosure having a transmittance-to-reflectance ratio that is configured to homogenize light that emerges from the enclosure directly from the at least one LED and after one or more reflections within the enclosure, wherein the enclosure comprises a microcellular layer having a mean cell diameter of less than about 10 μm.

2. A light emitting diode (LED) lighting system comprising:

at least one LED; and an enclosure adjacent the at least one LED and configured so that at least some light that is emitted by the at least one LED passes through the enclosure, the enclosure having a transmittance-to-reflectance ratio that is configured to homogenize light that emerges from the enclosure directly from the at least one LED and after one or more reflections within the enclosure, wherein the enclosure comprises a microporous layer.

3. An LED lighting system according to claim 2 wherein the enclosure has less than about 10% total absorption of the light that is emitted by the at least one LED.

4. An LED lighting system according to claim 2 wherein the enclosure has less than about 4% total absorption of the light that is emitted by the at least one LED.

5. A light emitting diode (LED) lighting system comprising:

at least one LED; and an enclosure adjacent the at least one LED and configured so that at least some light that is emitted by the at least one LED passes through the enclosure, the enclosure having a transmittance-to-reflectance ratio that is configured to homogenize light that emerges from the enclosure directly from the at least one LED and after one or more reflections within the enclosure, wherein the enclosure comprises a layer of microcellular polyethylene terephthalate (MCPET) and/or a layer of Diffuse Light Reflector (DLR) material.

6. An LED lighting system according to claim 5 wherein the layer of MCPET and/or DLR material is of variable thickness at different locations thereof to provide a transmittance-to-reflectance ratio that varies at different locations thereof.

7. An LED lighting system according to claim 5 wherein the layer of MCPET and/or DLR material includes a non-uniform array of holes extending therethrough to provide a transmittance-to-reflectance ratio that varies at different locations thereof.

8. An LED lighting system according to claim 5 wherein the enclosure further comprises a layer of variable thickness on the layer of MCPET and/or DLR material.

9. An LED lighting system according to claim 5 wherein the enclosure further comprises a patterned layer on the layer of MCPET and/or DLR material.

10. A light emitting diode (LED) lighting system comprising:

at least one LED; and an enclosure adjacent the at least one LED and configured so that at least some light that is emitted by the at least one LED passes through the enclosure, the enclosure having a transmittance-to-reflectance ratio that is configured to homogenize light that emerges from the enclosure directly from the at least one LED and after one or more reflections within the enclosure, wherein the enclosure has a transmittance-to-reflectance ratio that varies at different locations thereof.

11. A light emitting diode (LED) lighting system comprising:

at least one LED; and an enclosure adjacent the at least one LED and configured so that at least some light that is emitted by the at least one LED passes through the enclosure, the enclosure having a transmittance-to-reflectance ratio that is configured to homogenize light that emerges from the enclosure directly from the at least one LED and after one or more reflections within the enclosure, wherein the enclosure comprises an array of holes therein.

12. A light emitting diode (LED) lighting system comprising:

at least one LED; and an enclosure adjacent the at least one LED and configured so that at least some light that is emitted by the at least one LED passes through the enclosure, the enclosure having a transmittance-to-reflectance ratio that is configured to homogenize light that emerges from the enclosure directly from the at least one LED and after one or more reflections within the enclosure, wherein the enclosure comprises a bulb-shaped enclosure and a base at the base of the bulb-shaped enclosure.

13. An LED lighting system according to claim 12 wherein the bulb-shaped enclosure has higher transmittance-to-reflectance ratio remote from the base than adjacent the base.

14. An LED lighting system according to claim 12 wherein the LED lighting system further conforms to the ENERGY STAR Program Requirements for Solid State Lighting Luminaires.

15. An LED lighting system according to claim 12 wherein the at least one LED comprises first and second LEDs of different colors.

16. A light emitting diode (LED) lighting system comprising:

at least one LED; and an enclosure adjacent the at least one LED and configured so that at least some light that is emitted by the at least one LED passes through the enclosure, the enclosure having a transmittance-to-reflectance ratio that is configured to homogenize light that emerges from the enclosure directly from the at least one LED and after one or more reflections within the enclosure, wherein the LED lighting system further conforms to the product requirements for light output, wattage, color rendering index, correlated color temperature, dimensions and base type of a 60-watt A19 or a PAR 38 Incandescent Replacement for the L Prize.

17. A light emitting diode (LED) lighting system comprising:

at least one LED; and a layer adjacent the at least one LED and configured so that at least some light that is emitted by the at least one LED passes through the layer, the layer having a transmittance-to-reflectance ratio that varies at different locations thereof, wherein the layer comprises a microcellular layer having a mean cell diameter of less than about 10μm.

18. An LED lighting system according to claim 17 wherein the layer has less than about 10% total absorption of the light that is emitted by the at least one LED.

19. An LED lighting system according to claim 18 wherein the layer comprises a bulb-shaped layer, the LED lighting system further comprising a screw-type base at the base of the bulb-shaped layer.

20. An LED lighting system according to claim 19 wherein the LED lighting system further conforms to the ENERGY STAR Program Requirements for Solid State Lighting Luminaires.

21. An LED lighting system according to claim 17 wherein the layer has less than about 4% total absorption of the light that is emitted by the at least one LED.

22. An LED lighting system according to claim 17 wherein the LED lighting system further conforms to the product requirements for light output, wattage, color rendering index, correlated color temperature, dimensions and base type of a 60-watt A19 or a PAR 38 Incandescent Replacement for the L Prize.

23. An LED lighting system according to claim 17 wherein the at least one LED comprises first and second LEDs of different colors.

24. A light emitting diode (LED) lighting system comprising:

at least one LED; and a layer adjacent the at least one LED and configured so that at least some light that is emitted by the at least one LED passes through the layer, the layer having a transmittance-to-reflectance ratio that varies at different locations thereof, wherein the layer comprises a microporous layer.

25. An LED lighting system according to claim 24 wherein the layer is of variable thickness at different locations thereof to provide the transmittance-to-reflectance ratio that varies at different locations thereof.

26. A light emitting diode (LED) lighting system comprising:

at least one LED; and a layer adjacent the at least one LED and configured so that at least some light that is emitted by the at least one LED passes through the layer, the layer having a transmittance-to-reflectance ratio that varies at different locations thereof, wherein the layer comprises microcellular polyethylene terephthalate (MCPET) and/or Diffuse Light Reflector (DLR) material.

27. A light emitting diode (LED) lighting system comprising:

at least one LED; and a layer adjacent the at least one LED and configured so that at least some light that is emitted by the at least one LED passes through the layer, the layer having a transmittance-to-reflectance ratio that varies at different locations thereof, wherein the layer includes a non-uniform array of holes extending therethrough to provide the transmittance-to-reflectance ratio that varies at different locations thereof.

28. A light emitting diode (LED) lighting system comprising:

at least one LED; and a layer adjacent the at least one LED and configured so that at least some light that is emitted by the at least one LED passes through the layer, the layer having a transmittance-to-reflectance ratio that varies at different locations thereof, wherein the layer comprises a bulb-shaped layer, the LED lighting system further comprising a base at the base of the bulb-shaped layer, and wherein the bulb-shaped layer has higher transmittance-to-reflectance ratio remote from the base than adjacent the base.

29. A light emitting diode (LED) lighting system comprising:

at least one LED; and a layer adjacent the at least one LED and configured so that at least some light that is emitted by the at least one LED passes through the layer, wherein the layer comprises a microcellular layer having a mean cell diameter of less than about 10μm.

30. A light emitting diode (LED) lighting system comprising:

at least one LED; and a layer adjacent the at least one LED and configured so that at least some light that is emitted by the at least one LED passes through the layer, wherein the layer comprises a microporous layer.

31. An LED lighting system according to claim 30 wherein the LED lighting system further conforms to the ENERGY STAR Program Requirements for Solid State Lighting Luminaires.

32. A light emitting diode (LED) lighting system comprising:

at least one LED; and a layer adjacent the at least one LED and configured so that at least some light that is emitted by the at least one LED passes through the layer, wherein the layer comprises microcellular polyethylene terephthalate (MCPET) and/or Diffuse Light Reflector (DLR) material.

33. An LED lighting system according to claim 32 wherein the layer of MCPET and/or DLR material is of variable thickness at different locations thereof to provide a transmittance-to-reflectance ratio that varies at different locations thereof.

34. An LED lighting system according to claim 32 wherein the layer of MCPET and/or DLR material includes a non-uniform array of holes extending therethrough to provide a transmittance-to-reflectance ratio that varies at different locations thereof.

35. A light emitting diode (LED) lighting system comprising:

at least one LED; and a layer adjacent the at least one LED and configured so that at least some light that is emitted by the at least one LED passes through the layer, the layer comprising light diffusing material having less than about 4% total absorption of the light that is emitted by the at least one LED, wherein the layer comprises a bulb-shaped layer, the LED lighting system further comprising a base at the base of the bulb-shaped layer.

36. An LED lighting system according to claim 35 wherein the bulb-shaped layer has higher transmittance-to-reflectance ratio remote from the base than adjacent the base.

37. An LED lighting system according to claim 35 wherein the at least one LED comprises first and second LEDs of different colors.

38. A light emitting diode (LED) lighting system comprising:

at least one LED; and a layer adjacent the at least one LED and configured so that at least some light that is emitted by the at least one LED passes through the layer, the layer comprising light diffusing material having less than about 4% total absorption of the light that is emitted by the at least one LED, wherein the LED lighting system further conforms to the product requirements for light output, wattage, color rendering index, correlated color temperature, dimensions and base type of a 60-watt A19 or a PAR 38 Incandescent Replacement for the L Prize.

* * * * *

UNITED STATES PATENT AND TRADEMARK OFFICE

CERTIFICATE OF CORRECTION

PATENT NO. : 8,360,604 B2
APPLICATION NO. : 12/570571
DATED : January 29, 2013
INVENTOR(S) : Negley et al.

It is certified that error appears in the above-identified patent and that said Letters Patent is hereby corrected as shown below:

In the Specifications:

Column 1, Line 55:
Correct "*Competition* (*L Prizen*™)", May 28, 2008,"
to read -- *Competition* (*L Prize*™)", May 28, 2008, --

Signed and Sealed this
Thirtieth Day of April, 2013

Teresa Stanek Rea
*Acting Director of the United States Patent and Trademark Office*